US006705700B2

(12) United States Patent
Murakami

(10) Patent No.: US 6,705,700 B2
(45) Date of Patent: Mar. 16, 2004

(54) LIQUID DISCHARGE HEAD, AND HEAD CARTRIDGE AND IMAGE FORMING APPARATUS USING SUCH LIQUID DISCHARGE HEAD

(75) Inventor: Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,730

(22) Filed: Apr. 22, 2003

(65) Prior Publication Data

US 2003/0197755 A1 Oct. 23, 2003

(30) Foreign Application Priority Data

Apr. 23, 2002 (JP) ..... 2002-121206

(51) Int. Cl.[7] ..... B41J 2/145; B41J 2/15; B41J 2/205

(52) U.S. Cl. ..... 347/40; 347/15

(58) Field of Search ..... 347/40, 15, 43

(56) References Cited

U.S. PATENT DOCUMENTS 4,746,935 A * 5/1988 Allen ..... 347/15
5,745,131 A * 4/1998 Kneezel et al. ..... 347/15
6,030,065 A * 2/2000 Fukuhata ..... 347/15
6,149,260 A * 11/2000 Minakuti ..... 347/15

* cited by examiner

*Primary Examiner*—Thinh Nguyen
(74) *Attorney, Agent, or Firm*—Fitzpatrick, Cella, Harper & Scinto

(57) ABSTRACT

A discharge port array is having first discharge port groups each having eight discharge ports (sixteen discharge ports in total) including an end discharge port, and a second discharge port group having the remaining discharge ports located at an intermediate portion between the first discharge port groups. As opposite to the discharge port array, a discharge port array has the second discharge port groups located at both end portions of the array and the first discharge port group located at an intermediate portion between the second discharge port groups. Ink droplets each having a volume of 5.0 pl are discharged from the discharge ports of the first discharge port groups, while ink droplets each having a volume of 2.5 pl are discharged from the discharge ports of the second discharge port group. With this configuration, generation of a stripe can be prevented upon solid printing.

12 Claims, 10 Drawing Sheets

LIQUID DISCHARGE HEAD, AND HEAD CARTRIDGE AND IMAGE FORMING APPARATUS USING SUCH LIQUID DISCHARGE HEAD

BACKGROUND OF THE INVENTION

1. Field of the Invention

The present invention relates to a liquid discharge head having nozzles for discharging liquid, and a head cartridge and an image forming apparatus that use such a liquid discharge head.

2. Description of the Related Art

Ink discharging methods of the ink jet recording type that have been widely used today may be roughly classified into a method that uses an electro-thermal converter (heater) as a discharge energy generating element that is used for discharging an ink droplet, and a method using a piezoelectric element for the same purpose. In both methods, it is possible to control discharge of an ink droplet using an electrical signal. For example, the principle of the ink droplet discharging method using the electro-thermal converter is that, by giving an electrical signal to an electro-thermal converter, ink near the electro-thermal converter is boiled in an instant and, based on rapid growth of a bubble that is generated due to a phase change of ink thereupon, an ink droplet is discharged at high speed. On the other hand, the principle of the ink droplet discharging method using the piezoelectric element is that, by giving an electrical signal to a piezoelectric element, the piezoelectric element displaces and, based on a pressure generated upon this displacement, an ink droplet is discharged. The former method has merits such that it is not necessary to so much space for the discharge energy generating element, a configuration of an ink jet print head is simple and thus integration of nozzles is easy, and so on.

Recently, following the increasing processing speed of personal computers and the spread of the Internet and so on, the demand for high-speed processing of color images have been increasing more and more, i.e. the demand for quick printing of recorded materials with high fineness and high gradation, that is, so-called extremely high-quality recorded materials, has been increasing, so that printers that can produce high-quality images at high speed have been demanded.

For obtaining a high-quality image with high fineness and high gradation, such a method is suitable that performs recording by discharging a very small ink droplet from each nozzle. On the other hand, for speed-up, it is necessary to discharge ink droplets repeatedly at a short period from nozzles. Further, it is also required that a carriage mounting thereon a print head moves at high speed synchronously with a response frequency of the head. When performing recording by repeatedly discharging a very small ink droplet from each nozzle as described above, a stripe 101, for example, is generated in an image of a paint-out printing portion, i.e. a solid printing portion 100, of a bar graph as shown in FIG. 10. The stripe 101 just corresponds to a transition portion between nth scan and (n+1)th scan.

FIG. 11B is an enlarged view of this transition portion, and FIG. 11A shows the state thereupon wherein ink droplets 102 are discharged from a head 103. When image data is solid, nozzles SEG0 to SEG255 are all driven at a high response frequency. Thus, due to discharge of ink droplets 102 from those nozzles in end regions of the image data, the air with viscosity around the discharged ink droplets moves at a speed substantially equal to that of the ink droplets. Then, the air over the whole discharge port array moves in the same direction as the ink droplets 102 so that a pressure-reduced state is generated in that portion. Accordingly, the air other than the air around the discharged ink droplets moves toward the pressure-reduced portion, so that air flows as shown by arrows in FIG. 11A are generated. As a result, a discharge direction of the ink droplets 102 discharged from the nozzles located in end regions of the nozzle array is dethroughted or mis-aligned toward the center of the nozzle array from expected positions due to the air flows, i.e. inward jetting of the ink droplets occurs. Further, due to air flows generated upon movement of a carriage in a main scanning direction upon recording, air flows toward the center of the nozzle array are generated, so that the discharge direction of the ink droplets 102 discharged from those nozzles located in the end regions of the nozzle array are mis-aligned toward the center of the nozzle array due to the air flows. As a result, there has been a problem that hit positions of the ink droplets on a recording medium are mis-aligned to cause the stripe 101 as shown in FIG. 11B ((dot) mis-alignment). If the discharge amount of ink is increased for preventing the generation of the stripe 101, waviness is caused on the recording medium due to overflow of ink from the recording medium or absorption of ink into the recording medium, thereby deteriorating a recording image. Particularly, in the image formation with high fineness and high resolution, it is important to reduce graininess and reproduce fine lines, and thus, it is required that a dot size be as small as possible. Accordingly, also from this aspect, it is not desirable. On the other hand, if a period for repetitive discharge of ink droplets is prolonged, the generation of air flows is eased. However, the speed of the printer is lowered, so that it is not possible to satisfy the users' demand for high-speed printing.

SUMMARY OF THE INVENTION

Therefore, it is an object of the present invention to provide a liquid discharge head that is capable of high-speed recording and can reduce generation of a stripe in a recording image, and further provide a head cartridge and an image forming apparatus that use such a liquid discharge head.

As a result of detailed review by the inventors, the following has been made clear.

(a) Not only the ink droplets discharged from those discharge ports located at end portions of the discharge port array are mis-aligned. For example, even in the state where ink droplets 102 are discharged from discharge ports of part of a head 103 as shown in FIG. 12A, the ink droplets 102 discharged from the discharge ports located at end portions in the discharge port array direction are mis-aligned toward an intermediate portion of the discharge ports. On the other hand, a stripe 101 between solid portions 100 becomes conspicuous in an image as shown in FIG. 12B when it appears at a transition portion between recording scans. Thus, particularly the end portions of the discharge port array causes a problem.

(b) As the number of discharging discharge ports upon recording is reduced, a mis-alignment amount of liquid droplets discharged from discharge ports at end portions of an image is reduced. It is estimated that this is because, due to the reduction in number of the discharging discharge ports, a pressure-reduced state at the intermediate portion of the discharging discharge ports is weakened so that air flows that cause mis-alignment become reluctant to occur. A relationship between the number of discharged liquid droplets and the mis-alignment is shown in FIG. 6 as a specific example, which will be described later. No mis-alignment in a direction perpendicular to the main scanning direction due to air flows occurs when only one liquid droplet is discharged. As the number of the discharged liquid droplets increases, the mis-alignment amount is increases. It is also estimated that, also in case of reduction in discharged liquid droplet amount, air flows become reluctant to occur inasmuch as a pressure-reduced state-at the intermediate portion of the discharging discharge ports is weakened.

(c) Further, as resolution in a sub-scanning direction for recording is lowered, the mis-alignment amount of liquid droplets discharged from discharge ports at the end portions is reduced.

(d) The present inventors have made detailed review based on the foregoing air flow model, and configured such that a volume of each of discharge ports at end portions is greater than a volume of each of discharge ports at an intermediate portion. As a result, the mis-alignment amount of liquid droplets discharged from the discharge ports at the end portions was reduced. As described above, it is estimated that this is because, due to the reduction in volume of the intermediate portion of the discharge port array, a pressure-reduced state caused by flying of liquid droplets at the intermediate portion was weakened. By incorporating it into a liquid discharge head that performs gradation recording by preparing discharge ports whose discharge amounts of liquid droplets are different, the foregoing misalignment amount can be achieved without increasing the size of the head.

For accomplishing the foregoing object based on the foregoing results of review, according to the present invention, there is provided a liquid discharge head having a plurality of discharge port arrays each having a plurality of discharge ports and each arranged substantially in parallel to a print medium conveying direction, and a plurality of discharge energy generating portions for discharging liquid from the discharge ports, respectively, the liquid discharge head moved to scan in a direction crossing the conveying direction, the liquid discharge head characterized in that each discharge port array includes first discharge ports each for discharging a liquid droplet of a first volume, and second discharge ports each for discharging a liquid droplet of a second volume being smaller than the first volume, the discharge port arrays that are adjacent to each other have each of the first and second discharge ports as a pair in the scanning direction, and at least one of the discharge port arrays is a first discharge port array including first discharge port groups respectively having the first discharge ports arranged on both end sides of the at least one discharge port array, each of the first discharge port groups including an end discharge port of the first discharge ports that discharges liquid contributing to image formation, the first discharge port array further including at least one second discharge port group having the second discharge ports arranged between the first discharge port groups.

In the liquid discharge head of the invention as configured above, the first discharge port groups having the discharge ports each discharging a liquid droplet of a large volume are arranged on both end sides of the discharge port array so as to include end discharge ports that contributes to image formation, and a volume of each of liquid droplets discharged from the discharge ports forming the second discharge port group arranged between the first discharge port groups is set small. With this configuration, a pressure-reduced state caused by flying of the liquid droplets discharged from the intermediate portion of the discharge port array is weakened, so that the mis-alignment amount of the liquid droplets discharged from the discharge ports located at the end portions of the discharge port array can be reduced.

Further, the liquid discharge head of the present invention can achieve reduction of the foregoing mis-alignment of the liquid droplets without increasing the size of the head in the configuration that can perform gradation recording.

It may be configured that a discharge port area of each of the first discharge ports forming the first discharge port group is greater than a discharge port area of each of the second discharge ports forming the second discharge port group.

It may be configured that each of the discharge energy generating portions has an electro-thermal converter that generates thermal energy for causing film boiling in liquid to discharge the liquid from the discharge ports.

According to the present invention, a head cartridge is characterized by comprising the liquid discharge head of the present invention and a liquid tank storing liquid to be supplied to the liquid discharge head.

It may be configured that the liquid tank is detachable relative to the liquid discharge head through attaching/detaching means.

According to the present invention, an image forming apparatus is characterized by comprising a mounting portion for the liquid discharge head of the present invention, wherein an image is formed on a print medium using liquid discharged from discharge ports of the liquid discharge head.

As described above, since the image forming apparatus of the present invention forms an image on a print medium using the liquid discharge head of the present invention, the amount of mis-alignment in which a liquid droplet is not discharged to an expected position on the print medium, which has been the conventional problem, is reduced. Thus, even if solid printing is carried out, a high-quality print image with high fineness and high gradation can be obtained without generating a stripe.

It may be configured that the mounting portion has a carriage that is movable for scanning in a direction crossing a print medium conveying direction.

Further, it may be configured that the liquid discharge head is detachably mounted on the carriage through attaching/detaching means.

DESCRIPTION OF THE PREFERRED EMBODIMENTS

Now, preferred embodiments of the present invention will be described with reference to the accompanying drawings.

Numerical values shown in the following respective embodiments are only an example, and the present invention is not limited thereto. Further, the present invention is not limited to the respective embodiments, but may include combinations thereof, and is further applicable to other techniques to be contained in the concept of the present invention as defined in the appended claims.

(First Embodiment)

One preferred embodiment wherein an image forming apparatus according to the present invention is applied to an ink jet printer will be described in detail referring to FIGS. 1 to 7.

Figure 1:
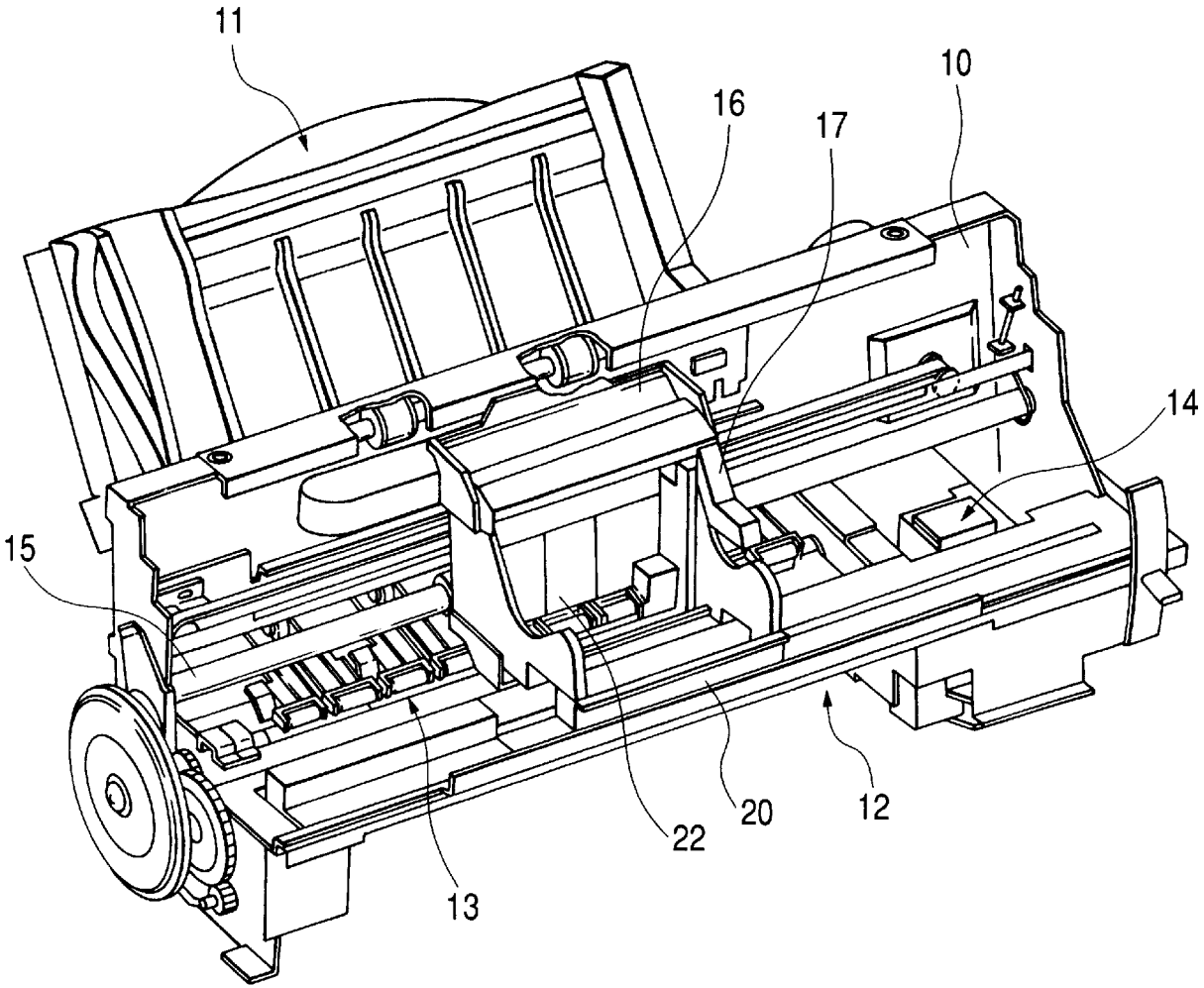
FIG. 1 is a perspective view showing a schematic configuration of one preferred embodiment wherein an image forming apparatus according to the present invention is applied to an ink jet printer.
Figure 2:
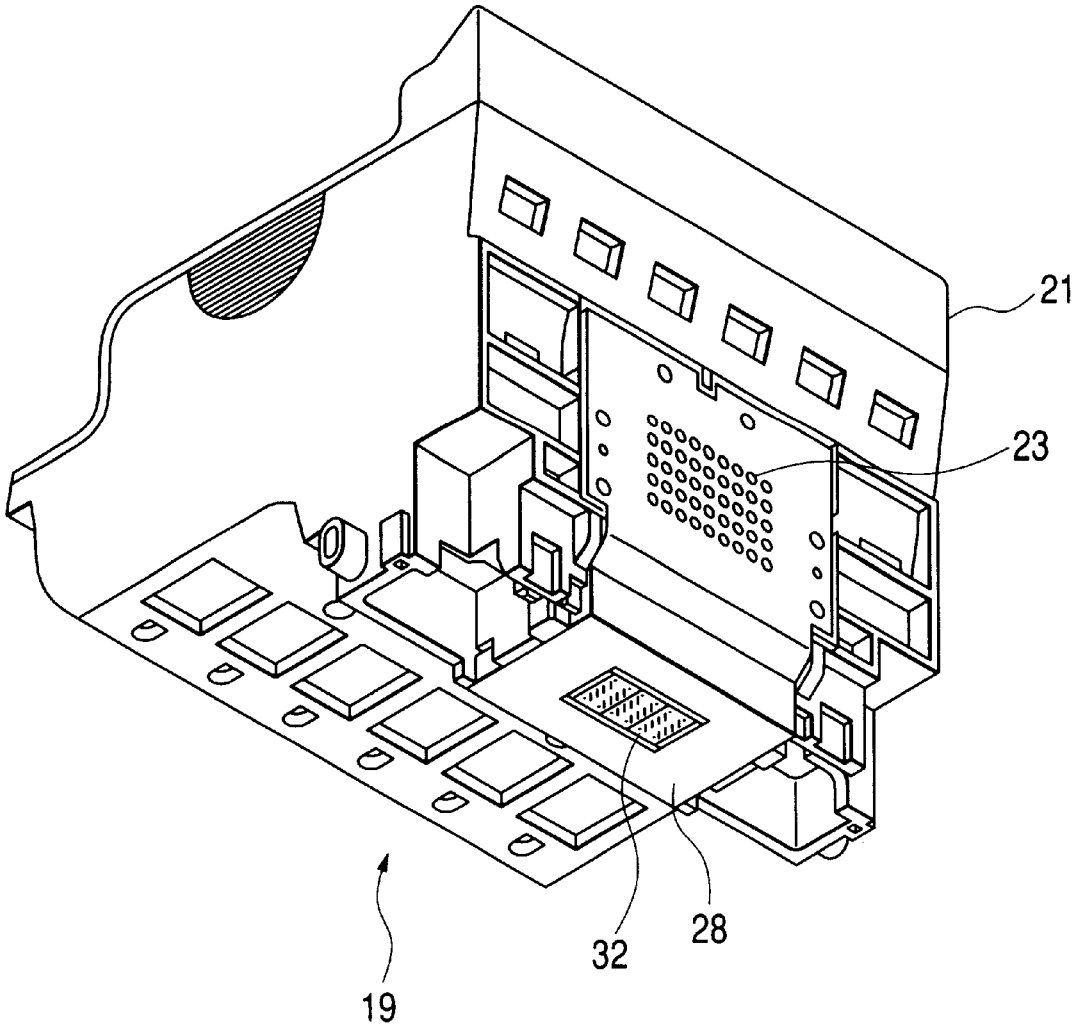
FIG. 2 is a perspective view showing an external appearance of one preferred embodiment in a disassembled state wherein a head cartridge according to the present invention is applied to the ink jet printer shown in FIG. 1.
Figure 3:
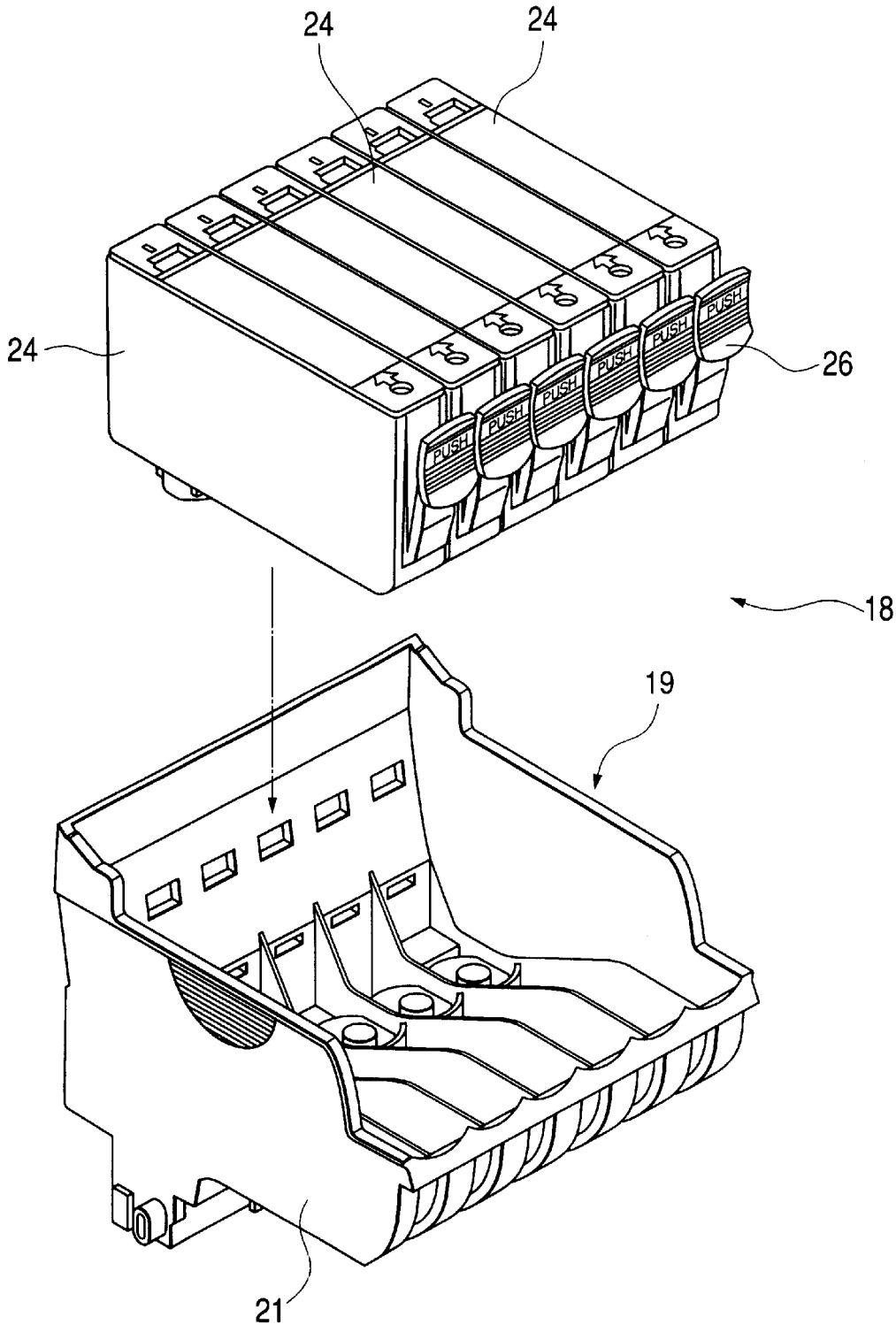
FIG. 3 is a perspective view of a print head in the head cartridge shown in FIG. 2.

An external appearance of a mechanical portion of the ink jet printer in this embodiment is shown in FIG. 1, an external appearance of a head cartridge used in this ink jet printer is shown in FIG. 2 in a disassembled state, and an external appearance of a print head thereof is shown in FIG. 3. Specifically, a chassis 10 of the ink jet printer in this embodiment is having a plurality of plate-shaped metal members having a prescribed rigidity, and forms a framework of the ink jet printer. On the chassis 10 are mounted a medium feed portion 11 for automatically feeding a print medium in the form of a sheet toward the inside of the ink jet printer, a medium conveying portion 13 for conveying a print medium fed one by one from the medium feed portion 11 to a given print-position and further conveying the print medium to a medium discharge portion 12, a print portion for carrying out a prescribed printing operation relative to the print medium conveyed to the print position, and a head recovery portion 14 for carrying out a recovery process relative to the print portion.

The print portion comprises a carriage 16 that is supported movably in a main scanning direction along a carriage shaft 15, and a head cartridge 18 detachably mounted onto the carriage 16 through a head set lever 17.

The carriage 16 to be mounted with the head cartridge 18 is provided with a carriage cover 20 for positioning a print head 19 of the head cartridge 18 in a prescribed mounting position on the carriage 16, and the foregoing head set lever 17 that engages with a tank holder 21 of the print head 19 and pushes it so as to place the print head 19 in the prescribed mounting position. The head set lever 17 is pivotally mounted on a head set lever shaft (not shown) at an upper portion of the carriage 16, and provided, at an engaging portion with the print head 19, with a head set plate (not shown) urged by a spring. By means of a spring force of the head set plate, the head set lever 17 pushes the print head 19 thereby to mount it onto the carriage 16.

One end of a contact flexible print cable (hereinafter referred to as "contact FPC") 22 (not shown) is connected to another engaging portion, relative to the print head 19, of the carriage 16. A contact portion (not shown) formed at such one end of the contact FPC 22 and a contact portion 23, as external signal input terminals, provided in the print head 19 are brought into contact with each other so as to be electrically connected therebetween, so that exchanges of various information for printing, power feeding to the print head 19, and so on can be performed.

Between the contact portion of the contact FPC 22 and the carriage 16 is provided an elastic member such as rubber. By means of an elastic force of this elastic member and a pushing force of the head set plate, the contact portion of the contact FPC 22 and the contact portion 23 of the print head 19 can be securely contacted therebetween. Another end of the contact FPC 22 is connected to a carriage substrate (not shown) mounted at the back of the carriage 16.

The head cartridge 18 in this embodiment comprises ink tanks 24 storing ink, and the foregoing print head 19 for discharging ink, supplied from the ink tanks 24, through discharge ports 25 (see FIG. 4) of the print head 19 according to print information. The print head 19 in this embodiment employs the so-called cartridge type wherein the print head 19 is detachably mounted onto the carriage 16.

In this embodiment, for enabling high-quality photographic color printing, the independent six ink tanks 24 can be used for the colors of, for example, black, light cyan, light magenta, cyan, magenta, and yellow, respectively. Each ink tank 24 is provided with an elastically deformable removing lever 26 that is retainable relative to the head cartridge 18. By operating this removing lever 26, each ink tank 24 is detachable relative to the print head 19 as shown in FIG. 3.

Figure 4:
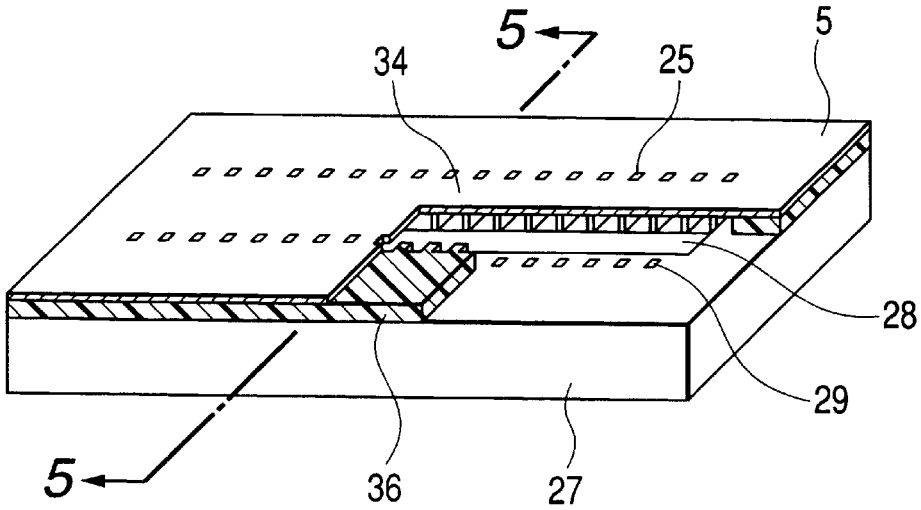
FIG. 4 is a cutaway perspective view showing a schematic configuration of the main part of the print head-shown in FIG. 3.
Figure 5:
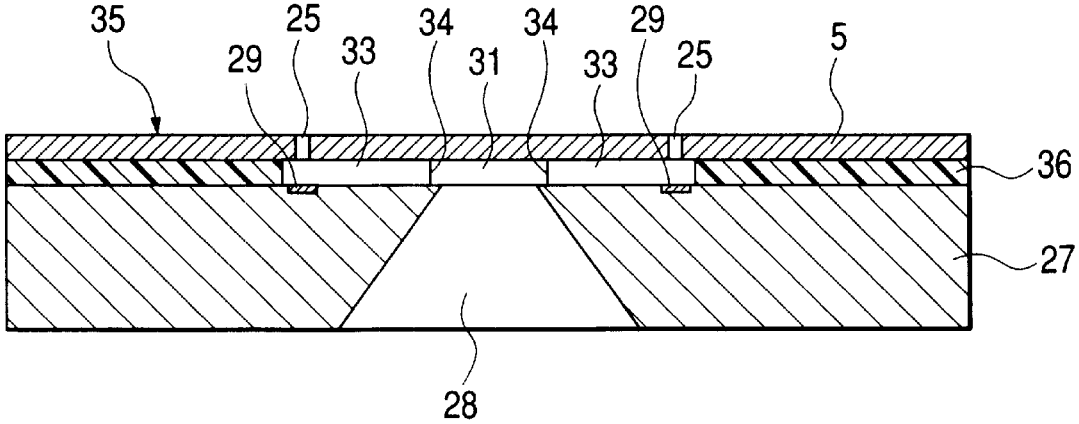
FIG. 5 is a sectional view, taken along line 5—5, of the print head shown in FIG. 4.

The print head 19 comprises a later-described print element substrate 27, the foregoing tank holder 21, and so on. FIG. 4 shows a cutaway configuration of the print element substrate 27 of the print head 19 in this embodiment, and FIG. 5 shows a 5—5 sectional configuration thereof. The print element substrate 27 in this embodiment is in the form of a silicon substrate having a thickness of 0.5 mm to 1 mm, on which discharge energy generating portions, common ink chambers 31, ink passages 33, discharge ports 25, and so on are formed using a film formation technique. Specifically, the print element substrate 27 is formed with ink supply ports 28 each in the form of an elongate hole penetrating the print element substrate 27, and stacked with a discharge port plate 5 formed with the discharge ports 25, through a coating resin layer 36. On both sides of the ink supply port 28, a plurality of electro-thermal converters 29 are formed in two lines each extending along a print medium conveying direction, i.e. along a longitudinal direction of the ink supply port 28. The electro-thermal converters 29 are arranged with a predetermined pitch in each line, and offset by a half pitch between the respective two lines. The electro-thermal converters 29 in each line form a discharge energy generating portion. A distance between the centers of the two lines is 233 μm. In this embodiment, the number of the electro-thermal converters 29 in each is 128. Apart from the electro-thermal converters 29, the print element substrate 27 is formed with electrode terminals 30 for electrical connection between the electro-thermal converters 29 and the side of a printer body, electrical wiring (not shown) made of aluminum or the like, and so on, using a film formation technique.

An electrical wiring substrate connected to the electrode terminals 30 formed on the print element substrate 27 is for applying electrical signals for discharging ink, to the print element substrate 27. The electrical wiring substrate has electrical wiring corresponding to the print element substrate 27, and the foregoing contact portion 23 located at an end portion of such electrical wiring for receiving electrical signals from the printer body. The contact portion 23 is fixed on the back side of the tank holder 21. A driving signal is given to the electro-thermal converter 29 from a driving IC (not shown) through the electrical wiring substrate, and simultaneously, driving power is fed to that electro-thermal converter 29.

The tank holder 21 detachably holding the ink tanks 24 is formed with ink flow passages extending from the ink tanks 24 to the corresponding ink supply ports 28 of the print element substrate 27.

On the print element substrate 27, an upper plate member 32 is formed that has the terminals 25 confronting the electro-thermal converters 29, respectively, through each of the common ink chambers 31 communicating with the corresponding ink supply ports 28. Specifically, the ink passages 33 each establishing communication between the corresponding discharge port 25 and the common ink chamber 31 are formed between the upper plate member 32 and the print element substrate 27, and partition walls 34 are formed between the adjacent ink passages 33. The common ink chambers 31, the ink passages 33, the partition walls 34, and so on are formed along with the upper plate member 32, like the discharge ports 25, using a photolithography technique.

Liquid supplied from the ink supply port 28 into each ink passage 33 boils following heat generation of the electro-thermal converter 29 exposed to the corresponding ink passage 33 when a driving signal is given to such an electro-thermal converter 29, and is discharged from the corresponding discharge port 25 due to a pressure of a bubble generated thereupon. In this event, a bubble generated in the liquid chamber 31 is, following growth thereof, brought into the state communicating with the air.

In the print head of this embodiment, the discharge ports 25 are arranged in two lines at a pitch of 600 dpi, with the 128 discharge ports 25 in each line. Volumes of discharged ink droplets are 5.0 pl and 2.5 pl, i.e. two kinds, and an ink density is 1.05. Since resolution of the ink jet printer in the carriage scanning direction is 600 dpi and a driving frequency is 15.0 kHz, the moving speed of the carriage is about 635 mm/s and one discharge port carries out discharge per about 66.7 μs at the minimum time interval. Further, a distance from the discharge port surface to the surface of the print medium is 1.5 mm. The ink jet printer carries out unidirectional recording.

Figure 6:
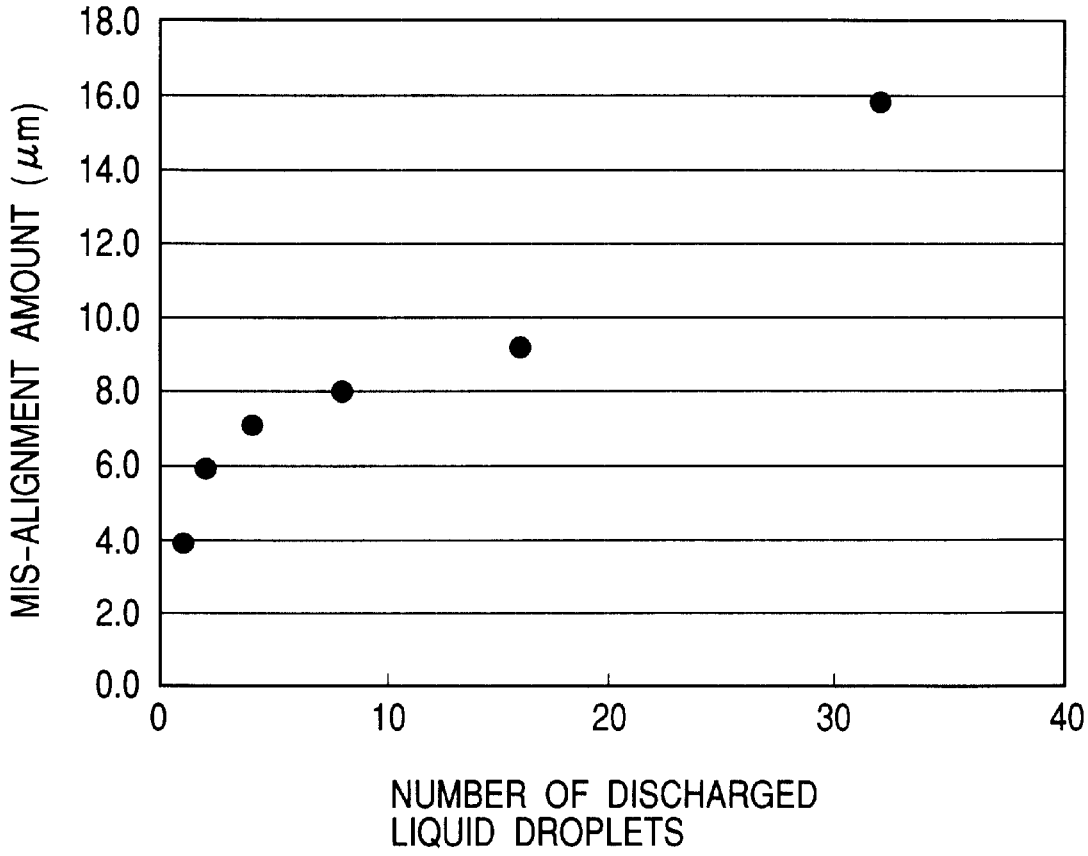
FIG. 6 is a graph showing a relationship between the number of discharged liquid droplets and mis-alignment amount.

According to the review by the present inventors, when the number of discharged liquid droplets that are simultaneously discharged from the discharge ports, i.e. when the number of the discharge ports that operate simultaneously, is eight or less on one side in a line, the mis-alignment amount of the discharged liquid droplets at the end portion is several μm or less as shown in FIG. 6, which raises no problem in view of the image quality.

Figure 7:
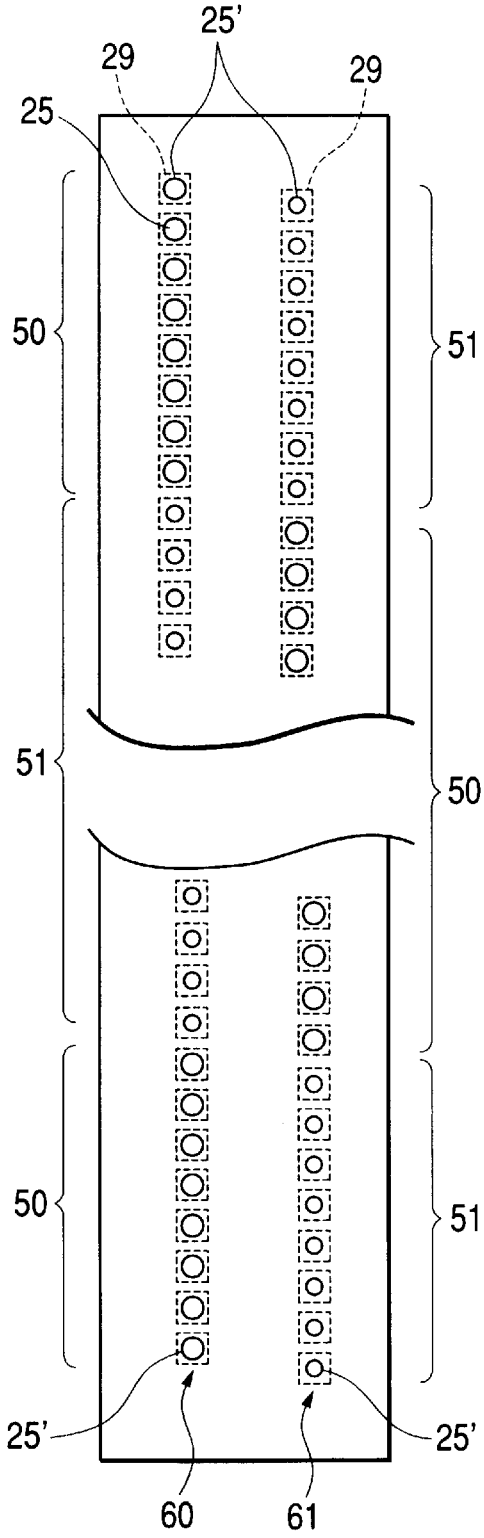
FIG. 7 is a plan view showing arrays of discharge ports and electro-thermal converters of a print head according to a first preferred embodiment of the present invention.

Therefore, in this embodiment, as shown in FIG. 7, a discharge port array 60 has first discharge port groups 50 each having, among the 128 discharge ports, the 8 discharge ports 25 located at one of two end portions (thus 16 discharge ports at both end portions) and including the end discharge port 25', and a second discharge port group 51 having the remaining 112 discharge ports located at an intermediate portion between the respective first discharge port groups 50. In this embodiment, ink droplets each having a volume of 5.0 pl are discharged from the first discharge port groups 50, and ink droplets each having a volume of 2.5 pl are discharged from the second discharge port group 51.

On the other hand, in a discharge port array 61, as opposed to the discharge port array 60, the second discharge port groups 51 are arranged on both end sides of the discharge port array, and the first discharge port group 50 is arranged at an intermediate portion between the second discharge port groups 51. A diameter of each discharge port 25 of the first discharge port group 50 that discharges 5 pl is set to Ø16.0 μm each of the electro-thermal converters is set to 26×26 μm, a diameter of each discharge port 25 of the second discharge port group 51 that discharges 2.5 pl is set to Ø11.0 μm, and each of the electro-thermal converters is set to 22×22 μm. A distance between the discharge port array 60 and the discharge port array 61 is set to 215 μm.

In this embodiment, the formed discharge ports 25 are all used for image formation. On the other hand, if dummy discharge ports are formed that are not used for image formation, the discharge port 25 located at an end among the discharge ports 25 excluding the dummy discharge ports is set as the end discharge port 25'.

In the ink jet printer of the present invention, those discharge ports with the volume of 5.0 pl are used for one-pass recording. In the print head of this embodiment, the first discharge port groups 50 corresponding to the 5.0 pl discharge ports are arranged being separated between the discharge port array 60 and the discharge port array 61, i.e. offset in the main scanning direction. Further, the second discharge port group 51 is arranged at the intermediate portion in the discharge port array 60 and the volume of each ink droplet discharged therefrom is reduced to 2.5 pl. As a result, the mis-alignment amount with respect to the 16 discharge ports 25 at the end portions upon one-pass recording was reduced to 5 μm while it was 20 cm in case of the compared conventional head, so that the stripe at the transition portion of the carriage scan did not appear.

The foregoing one-pass recording is one example wherein ink droplets were discharged from both the first discharge port groups 50 (5.0 pl discharge ports) and the second discharge port groups 51 (2.5 pl discharge ports). On the other hand, when one-pass recording was carried out by discharging ink droplets only from the first discharge port groups 50 (5.0 pl discharge ports) for achieving high-speed recording, the ink droplets were discharged only from the first discharge port groups 50 located at both end portions with respect to the discharge port array 60. Accordingly, inasmuch as ink droplets were not charged from the second discharge port group 51 located at the intermediate portion, a pressure-reduced state, which is caused by flying of liquid droplets at the intermediate portion, was not generated. Therefore, the mis-alignment becomes reluctant to occur so that the mis-alignment amount with respect to the 16 discharge ports at the end portions was reduced to 4 μm, and thus, the stripe did not appear at the transition portion of the carriage scan.

On the other hand, in the ink jet printer of the present invention, both 5.0 pl discharge ports and 2.5 pl discharge ports are used in case of multi-pass recording. When review was performed with four-pass recording being one of multi-pass recording, since the recording duty per pass was lowered, the end mis-alignment amount was reduced to about 6 μm. When recording was performed using 5.0 pl and 2.5 pl discharge ports, since it is more noticeable when the mis-alignment occurs with 5.0 pl discharge ports, there was no generation of stripes.

In this embodiment, each of the first discharge port groups 50 located at both end portions of the discharge port array 60 has the 8 discharge ports 25 and thus the 16 discharge ports 25 in total. However, the present invention is not limited those numbers.

(Second Embodiment)

In the foregoing first embodiment, the number of the discharge ports forming each discharge port array is set to 128. On the other hand, in this embodiment, description will be given about a print head wherein each discharge port array has 256 discharge ports and those discharge ports that discharge ink droplets of a large volume are arranged at an intermediate portion. Those elements having the same functions as those in the first embodiment are assigned the same reference symbols, thereby to omit duplicate explanation thereof.

Figure 8:
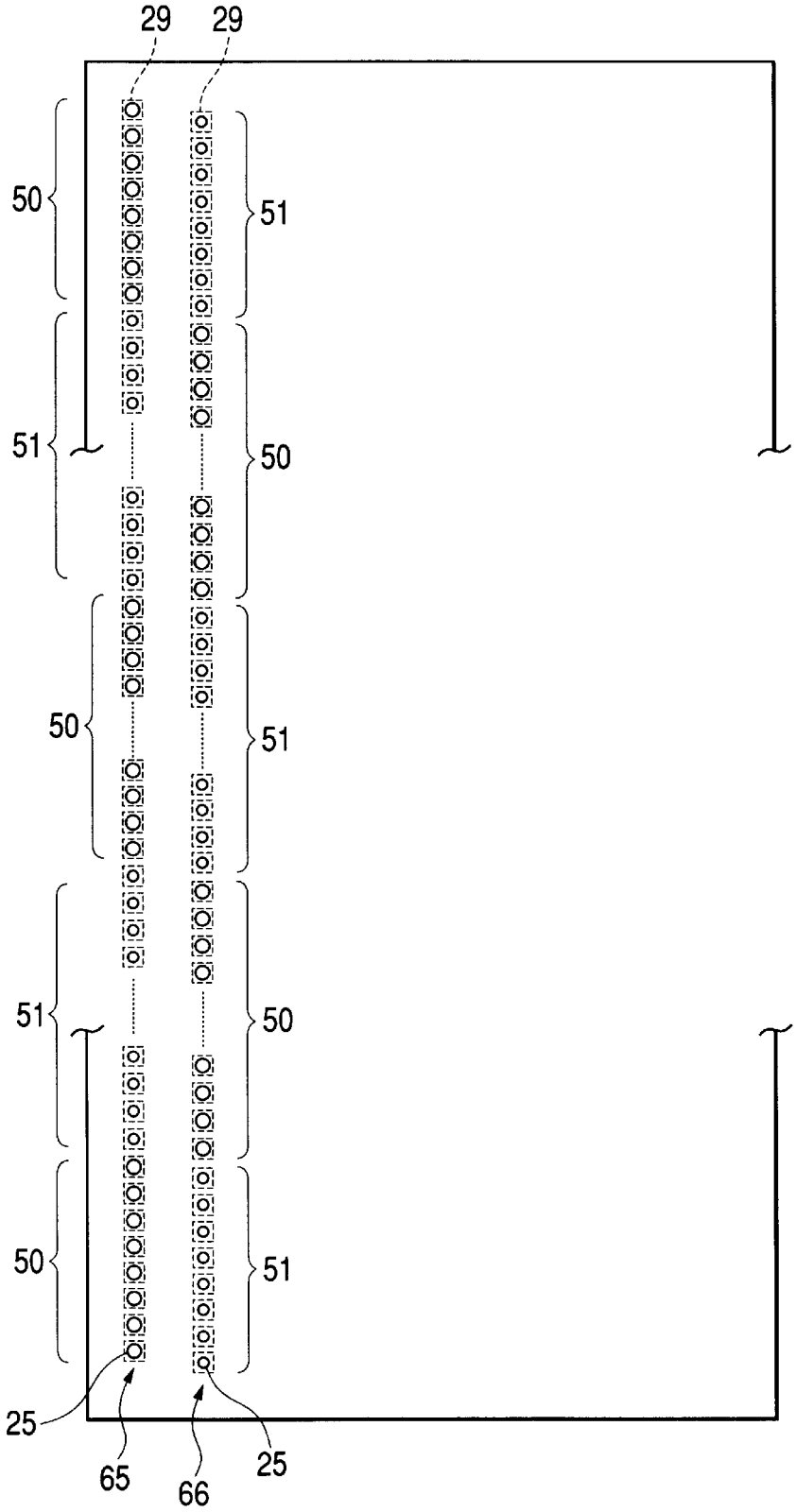
FIG. 8 is a cutaway plan view showing arrays of discharge ports and electro-thermal converters of a print head according to a second preferred embodiment of the present invention.

FIG. 8 is a cutaway plan view showing discharge port arrays of the print head in this embodiment.

A discharge port array 65 has first discharge port groups 50 arranged at both end portions and each having 8 discharge ports 25, and second discharge port groups 51 arranged adjacent to the first discharge port groups 50, respectively, and further has a first discharge port group 50 arranged between the second discharge port groups 51 and having 64 discharge ports 25.

On the other hand, as opposed to the discharge port array 65, a discharge port array 66 has second discharge port groups 51 arranged at both end portions and each having 8 discharge ports 25, and first discharge port groups 50 arranged adjacent to the second discharge port groups 51, respectively, and further has a second discharge port group 51 arranged between the first discharge port groups 50 and having 64 discharge ports 25.

With the foregoing arrays of the discharge ports 25, recording was carried out under the same condition as the first embodiment. As a result, the mis-alignment amount of the ink droplets discharged from the 16 discharge ports 25 at both end portions was reduced to 5 μm while it was 20 μm in case of the compared conventional head, so that the stripe at the transition portion of the carriage scan did not appear.

(Third Embodiment)

In the print head described in the foregoing first embodiment, the first and second discharge port arrays 60 and 61 are provided only as one pair. On the other hand, in a print head of this embodiment, the first and second discharge port arrays are provided as a plurality of pairs, so that bidirectional recording with reciprocating scanning can be carried out. Also in this embodiment, those elements having the same functions as those in the first embodiment are assigned the same reference symbols, thereby to omit duplicate explanation thereof.

Figure 9:
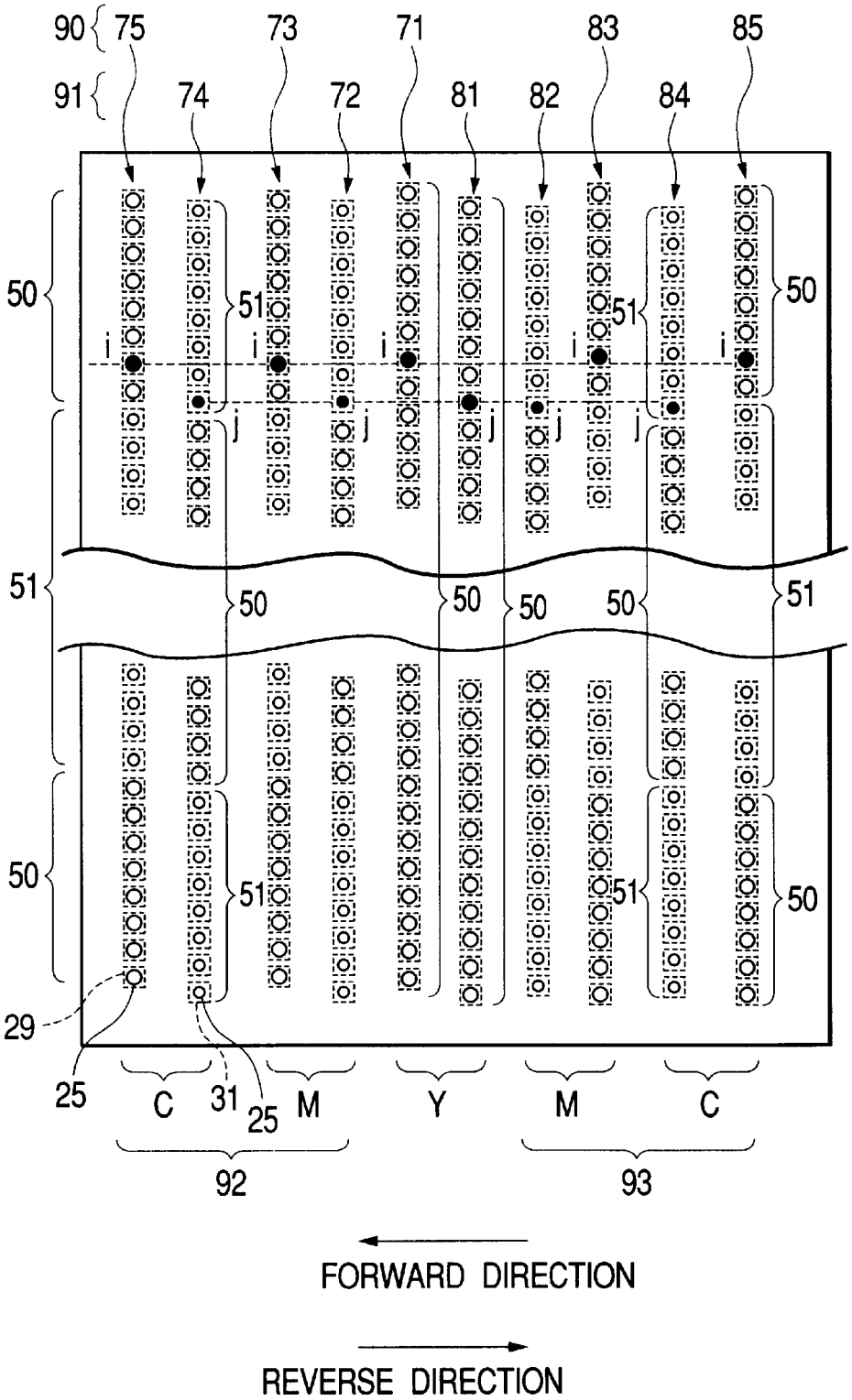
FIG. 9 is a cutaway plan view showing arrays of discharge ports and electro-thermal converters of a print head according to a third preferred embodiment of the present invention.
Figure 10:
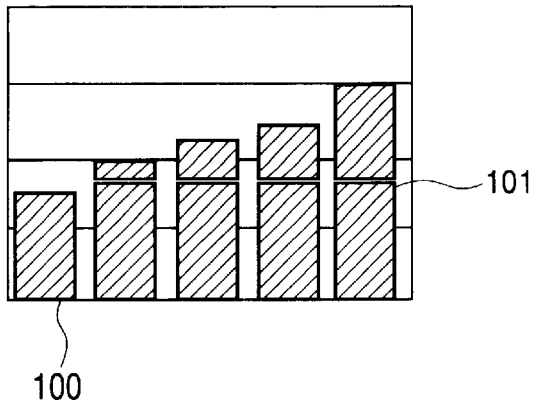
FIG. 10 is a diagram showing one example for explaining a stripe generated upon recording by a conventional print head.
Figure 11A:
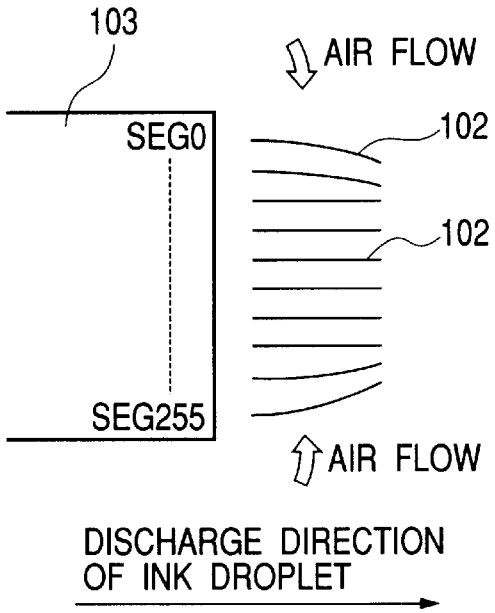
FIG. 11A is a conceptual diagram exemplarily showing one example of an ink discharging state caused by a conventional ink jet printer.
Figure 11B:
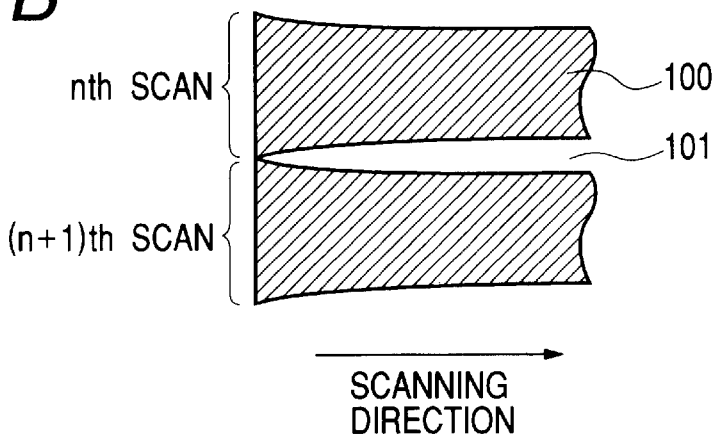
FIG. 11B is a conceptual diagram exemplarily showing one example of a solid image formed on a print medium in one pass.
Figure 12A:
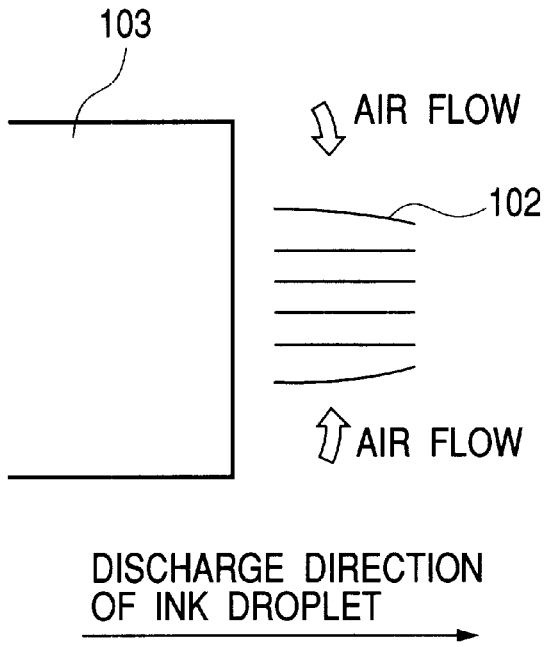
FIG. 12A is a conceptual diagram exemplarily showing another example of an ink discharging state caused by a conventional ink jet printer.
Figure 12B:
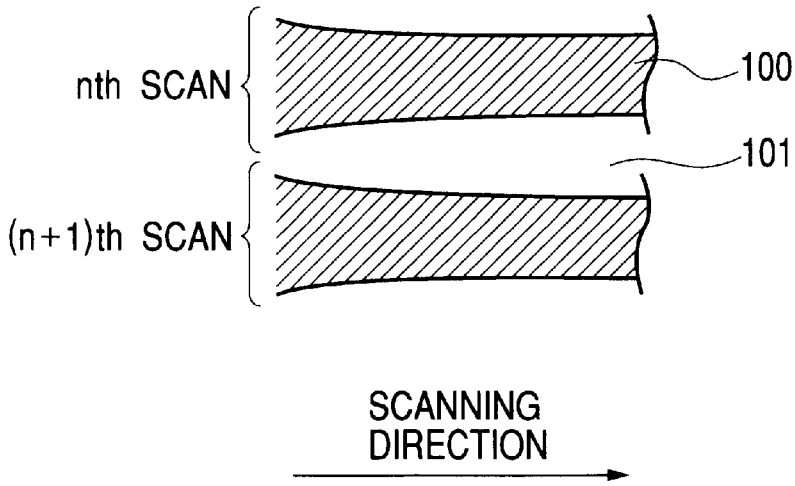
FIG. 12B is a conceptual diagram exemplarily showing another example of a solid image formed on a print medium in one pass.

FIG. 9 is a cutaway plan view showing discharge port arrays of the print head in this embodiment.

In the print head of this embodiment, 10 discharge port arrays 71 to 75 and 81 to 85 are arranged at a prescribed pitch. Each of the discharge port arrays 73, 75, 83 and 85 has the first discharge port arrays 50 arranged at both end portions and the second discharge port group 51 arranged therebetween, which is the same as the discharge port array 60 in the first embodiment. On the other hand, each of the discharge port arrays 72, 74, 82 and 84 has the second discharge port arrays 51 arranged at both end portions, and the first discharge port array 50 is arranged therebetween, which is the same as the discharge port array 61 in the first embodiment. Further, each of the discharge port arrays 71 and 81 is having only the first discharge port group 50.

The discharge port arrays 75, 73, 71, 83 and 85 form a first discharge port array group 90 wherein the discharge ports thereof are arranged such that the ith discharge ports correspond to each other as shown by a broken line in FIG. 9. On the other hand, the discharge port arrays 74, 72, 81, 82 and 84 form a second discharge port array group 91 wherein the discharge ports thereof are arranged such that the jth discharge ports correspond to each other as shown by a broken line in FIG. 9.

Further, among the 10 discharge port arrays, the outermost discharge port arrays 74, 75, 84 and 85 discharge cyan (C), the discharge port arrays 72, 73, 82 and 83 discharge magenta (M), and the innermost discharge port array 71 and 81 adjacent to each other discharge yellow (Y).

In this embodiment, 128 discharge ports are arranged in each array at a pitch of 1200 dpi, and ink droplets are discharged toward a print medium from the discharge ports. A volume of each discharged ink droplet is 5.0 pl and an ink density is 1.05, so that the volume is large enough to fill dots relative to resolution of 1200 dpi in a sub-scanning direction (discharge port array direction) so as not to generate a white stripe upon recording. In the ink jet printer, resolution in the carriage scanning direction is 600 dpi, recording resolution is 1200 dpi and a driving frequency is 15. Accordingly, the moving speed of the carriage is about 635 mm/s and one discharge port carries out discharge per about 80 μs at the minimum time interval. Further, a distance from the discharge port surface to the surface of the print medium is 1.5 mm. The ink jet printer carries out bidirectional recording.

Based on the detailed review by the present inventor, comparison was made between a head wherein the discharge port groups arranged at both end portions in the discharge port array direction in the discharge port array are offset in an advancing direction (forward) of the main scan relative to the discharge port group arranged at the intermediate portion and a head wherein, as opposite thereto, the discharge port arrays at both end portions are offset in a direction opposite (backward) to the advancing direction of the main scan relative to the discharge port array at the intermediate portion. As a result, it has been made clear that the mis-alignment amount of liquid droplets discharged from the discharge ports at the end portions was 6 μm in the former, which was smaller than 9 μm of the latter. Therefore, in the bidirectional head of this embodiment, in a first discharge port region 92 having the discharge port arrays 72 to 75, 5.0 pl discharge ports are provided in the array on the left in the figure for each color, while 2.5 pl discharge ports are provided on the right in the figure, on the other hand, in a second discharge port region 93 having the discharge port arrays 82 to 85, 5.0 pl discharge ports are provided in the array on the right in the figure for each color, while 2.5 pl discharge ports are provided on the left in the figure. For example, with respect to the discharge port arrays 74, 75, 84 and 85 that discharge cyan ink, assuming that ink droplets are discharged using 5.0 pl discharge ports, by discharging the ink droplets using, in combination, the first discharge port groups 50 located at both end portions of the discharge port array 75 and the first discharge port group 50 located at the intermediate portion of the discharge port array 74 upon forward direction recording, the end mis-alignment amount of the first discharge port arrays 50 located at both end portions of the discharge port array 75 can be reduced. On the other hand, upon reverse direction recording, by discharging the ink droplets using, in combination, the first discharge port groups 50 located at both end portions of the discharge port array 85 and the first discharge port group 50 located at the intermediate portion of the discharge port array 84, the end mis-alignment amount of the first discharge port arrays 50 located at both end portions of the discharge port array 85 can be reduced.

Specifically, by configuring discharge port arrays arranged at both ends in a scanning direction as discharge port arrays each having on both end sides the first discharge port groups 50 that discharge liquid of a large volume, the discharge port array having on both end sides the first discharge port groups 50 that discharge liquid of a large volume can be always located in a forward position with respect to the scanning direction, in each of bidirectional directions upon reciprocating scanning. When the foregoing discharge is carried out, upon forward direction recording, the first discharge port groups 50 on both end sides of the discharge port array 75 first discharge liquid droplets, then the first discharge port group 50 at the intermediate portion of the discharge port array 74 discharge liquid droplets. Specifically, in the discharge port array 75, since liquid droplets are not discharged from the intermediate portion, but discharged only from both end sides, the liquid droplets discharged from both end sides of the discharge port array 75 are free from an influence of pressure reduction at the intermediate portion of the discharge port array 75 itself. In addition, since the discharge from the intermediate portion of the discharge port array 74 is carried out after the discharge from both end sides of the discharge port array 75 has been performed. Accordingly, the liquid droplets discharged from both end sides of the discharge port array 75 are liable to escape from an influence of the liquid droplets discharged from the intermediate portion of the discharge port array 74. Therefore, the mis-alignment amount of the liquid droplets at the end portions of the discharge port array can be reduced.

In this manner, by equalizing per scan the mis-alignment amounts of two spaced-apart discharge port arrays (e.g. discharge port arrays 75 and 85) for the same color, which are scanned through one scan, generation of the stripe can be suppressed.

What is claimed is:

1. A liquid discharge head having a plurality of discharge port arrays each having a plurality of discharge ports and each arranged substantially in parallel to a print medium conveying direction, and a plurality of discharge energy generating portions for discharging liquid from said discharge ports, respectively, said liquid discharge head moved to scan in a direction crossing said conveying direction, said liquid discharge head characterized in that each discharge port array includes first discharge ports each for discharging a liquid droplet of a first volume, and second discharge ports each for discharging a liquid droplet of a second volume being smaller than said first volume, said discharge port arrays that are adjacent to each other have each of said first and second discharge ports as a pair in said scanning direction, and at least one of said discharge port arrays is a first discharge port array including first discharge port groups respectively having said first discharge ports arranged on both end sides of said at least one discharge port array, each of said first discharge port groups including an end discharge port of said first discharge ports that discharges liquid contributing to image formation, said first discharge port array further including at least one second discharge port group having said second discharge ports arranged between said first discharge port groups.

2. A liquid discharge head according to claim 1, characterized in that said first discharge port array is arranged in a forward position relative to said scanning direction upon recording.

3. A liquid discharge head according to claim 1, characterized by having said first discharge port array in which said second discharge port group is arranged between said first discharge port groups.

4. A liquid discharge head according to claim 1, characterized in that said liquid discharge head performs reciprocating scanning in a direction crossing said print medium conveying direction and, among said plurality of discharge port arrays, the discharge port array located at each of both ends in said scanning direction is said first discharge port array.

5. A liquid discharge head according to claim 1, characterized in that a discharge port area of each of the first discharge ports forming said first discharge port group is greater than a discharge port area of each of the second discharge ports forming said second discharge port group.

6. A liquid discharge head according to claim 1, characterized in that each of said discharge energy generating portions has an electro-thermal converter that generates thermal energy for causing film boiling in liquid to discharge the liquid from said discharge ports.

7. A head cartridge characterized by comprising the liquid discharge head according to claim 1 and a liquid tank storing liquid to be supplied to said liquid discharge head.

8. A head cartridge according to claim 7, characterized in that said liquid tank is detachable relative to said liquid discharge head through attaching/detaching means.

9. An image forming apparatus characterized by comprising a mounting portion for mounting the liquid discharge head according to claim 1, wherein an image is formed on a print medium using liquid discharged from discharge ports of said liquid discharge head.

10. An image forming apparatus according to claim 9, characterized in that said mounting portion has a carriage that is movable for scanning in a direction crossing a print medium conveying direction.

11. An image forming apparatus according to claim 10, characterized in that said liquid discharge head is detachably mounted on said carriage through attaching/detaching means.

12. A liquid discharge head having a plurality of discharge port arrays each having a plurality of discharge ports and each arranged substantially in parallel to a print medium conveying direction, and a plurality of discharge energy generating portions for discharging liquid from said discharge ports, respectively, said liquid discharge head moved to scan in a direction crossing said conveying direction, said liquid discharge head characterized in that each discharge port array includes first discharge ports each for discharging a liquid droplet of a first volume, and second discharge ports each for discharging a liquid droplet of a second volume being smaller than said first volume, said discharge port arrays that are adjacent to each other have each of said first and second discharge ports as a pair in said scanning direction, and said liquid discharge head has a first discharge port array wherein first discharge port groups each having said first discharge ports are arranged on both end sides of said discharge port array so as to include end discharge ports of said first discharge ports that discharge liquid contributing to image formation, and at least one second discharge port group having said second discharge ports is arranged between said first discharge port groups, said liquid discharge head further having a first discharge mode that performs recording using only said first discharge ports, and a second discharge mode that performs gradation recording using said first discharge ports and said second discharge ports.

* * * * *